United States Patent [19]

Straslicka

[11] 4,456,032

[45] Jun. 26, 1984

[54] FLUID ADMISSION VALVE STRUCTURE

[75] Inventor: William A. Straslicka, Norvelt, Pa.

[73] Assignee: Elliott Turbomachinery Company, Inc., Jeannette, Pa.

[21] Appl. No.: 340,427

[22] Filed: Jan. 18, 1982

[51] Int. Cl.[3] ..... F16K 1/00

[52] U.S. Cl. ..... 137/630.19; 415/155

[58] Field of Search ..... 415/155; 137/630.19, 137/629

[56] References Cited

U.S. PATENT DOCUMENTS

| | | | |
|---|---|---|---|
| 2,192,193 | 3/1940 | Johnson | 137/630.19 |
| 2,385,537 | 9/1945 | Penthenny | 137/630.19 |
| 3,322,153 | 5/1967 | Rankin | 137/630.19 |
| 3,580,691 | 5/1971 | Czuszak | 415/155 |
| 3,625,241 | 12/1971 | Shields | 137/630.19 |
| 3,753,449 | 8/1973 | Nelson et al. | 137/630.19 |
| 3,763,894 | 10/1973 | Meyer | 137/630.19 |

FOREIGN PATENT DOCUMENTS

| | | | |
|---|---|---|---|
| 767163 | 10/1951 | Fed. Rep. of Germany | 137/630.19 |

*Primary Examiner*—Robert G. Nilson
*Attorney, Agent, or Firm*—Robert P. Hayter

[57] ABSTRACT

In an admission valve structure for a turbine all of the valves except the first opening one are spring biased closed, when seated. Because of the sequential opening of the valves, the valve closing bias of each spring acts as an opening bias relative to all earlier opening valves until that valve is opened. The combined spring forces act to open at least some of the valves thus permitting the governor to attain minimum speed once the throttle valve is opened in the steam header.

7 Claims, 5 Drawing Figures

FLUID ADMISSION VALVE STRUCTURE

BACKGROUND OF THE INVENTION

This invention relates to sequentially operable control valves for axial flow steam turbines.

Various valve arrangements are used to control the admission of steam into steam turbines. In one arrangement, the bottom wall of the steam chest is formed with a plurality of steam passages leading to steam nozzles. A precision machined seat is mounted in each passage. A valve is movable vertically into and out of engagement with each seat to control the admission of steam from the steam chest through the passages to the nozzles.

As the demand load on the turbine increases, the valves are moved upwardly from their seats in a predetermined sequential order by a valve lift bar which is mounted in the steam chest above the series of seats for movement toward and from the same. The lift bar is formed with an aperture vertically aligned with each valve seat. Each valve has a stem that extends upwardly through an aperture and is slidable in the aperture. The upper end portions of the valve stems are threaded to receive stop nuts. When the lift bar is moved upwardly, it engages the stop nuts on the valve stems, and moves the valves upwardly from their seats. The sequence in which the valves are moved from their seats and the extent of such movement is determined by the position of the stop nut on each valve stem, and jam nuts are provided to lock the stop nuts in adjusted position.

The lift bar is reciprocated vertically in the steam chest by a servomotor which is controlled by a governor, whereby the valves are opened and closed sequentially according to the load demand on the turbine. The sequential, rather than simultaneous, operation is employed to provide for the admission of steam to select groups of nozzles in a predetermined order for more efficient turbine operation and for better balance with minimum vibration. Accordingly, upon initial upward movement of the lift bar, a valve having stop nuts adjusted close to the lift bar will be first moved to open position. The valve of the series having the stop nuts on its stem adjusted to a higher position will open upon further upward movement of the lift bar, and so on. With the lift bar in its uppermost position, all of the valves are open, and as the lift bar is moved downwardly, the valves are closed in reverse sequential order.

The steam passing through the steam chest at high pressure and high velocity and with considerable turbulence imparts vibration of great magnitude in the lift bar and valves. Various solutions have been proposed for the solution of vibration caused problems such as the fatigue and failure of the valve parts, particularly the valve stems.

SUMMARY OF THE INVENTION

Except for the first opening valve, all of the valves are spring biased closed, when seated. However, because of the sequential opening of the valves, the valve closing bias of each spring acts as an opening bias relative to all earlier opening valves until that valve is opened. The spring bias of each valve acts together with, or in opposition to, the governor only when the valve is seated. Because the control bar is pivoted and located externally of the steam chest, less force is needed to move the valves and there is less flow resistance. It is therefore possible to use a smaller governor servomotor and to reduce the vibration producing forces on the valves. Additionally, the spring bias on the valves tends to completely damp out any vibrations.

It is an object of this invention to provide a spring bias which is additive to the opening force of a governor.

It is another object of this invention to provide a plurality of springs which simultaneously supply both valve opening and valve closing forces.

It is a further object of this invention to provide a self contained governor system with marginal input force which can satisfactorily control the steam admission valves to maintain unit load criteria.

It is a still further object of this invention to provide multiple steam admission valves some of which are opened in the absence of governor control as at start up. These objects, and others as will become apparent hereinafter, are accomplished by the present invention.

Basically, each spring biased valve has a compression spring mounted so as to act on the control bar and the valve stem. Since each of the spring biased valves have varying amounts of relative movement between their valve stems and the control bar, the spring bias of each valve tends to produce this relative movement between the valve stem and the control bar. For seated valves, this relative movement is achieved solely by movement of the control bar which is also an opening movement for earlier opening valves. In this way, on start up, the combined spring forces act to open at least some of the valves thus permitting the governor to attain minimum speed once the throttle valve is opened in the steam header.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
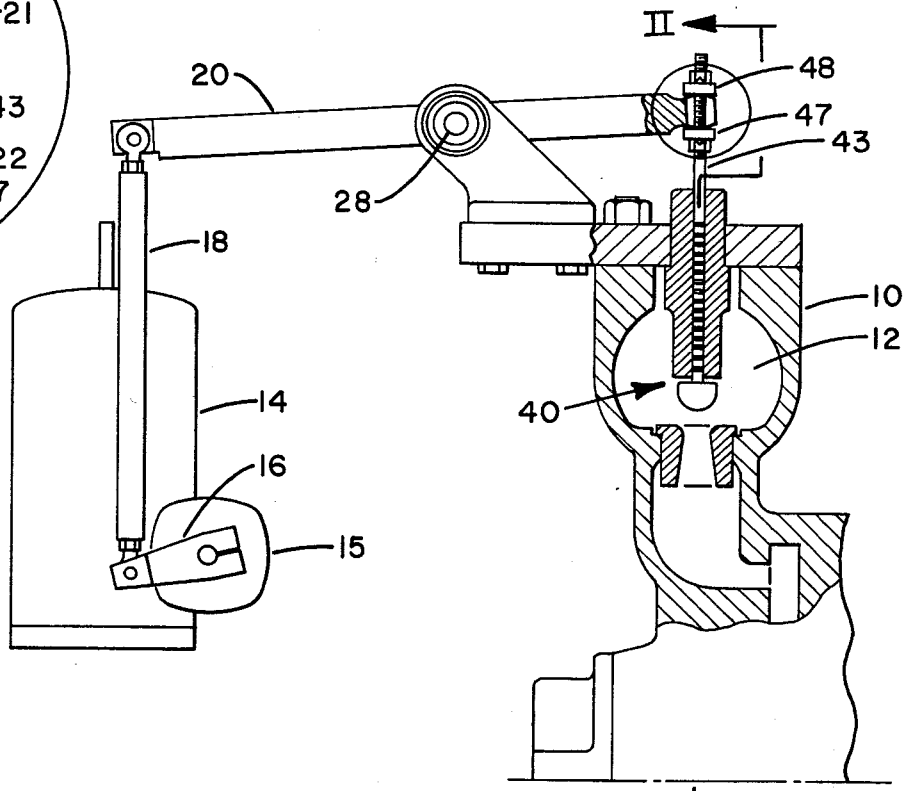
FIG. 1 is a partially sectioned vertical view of a steam turbine employing the present invention.
Figure 2:
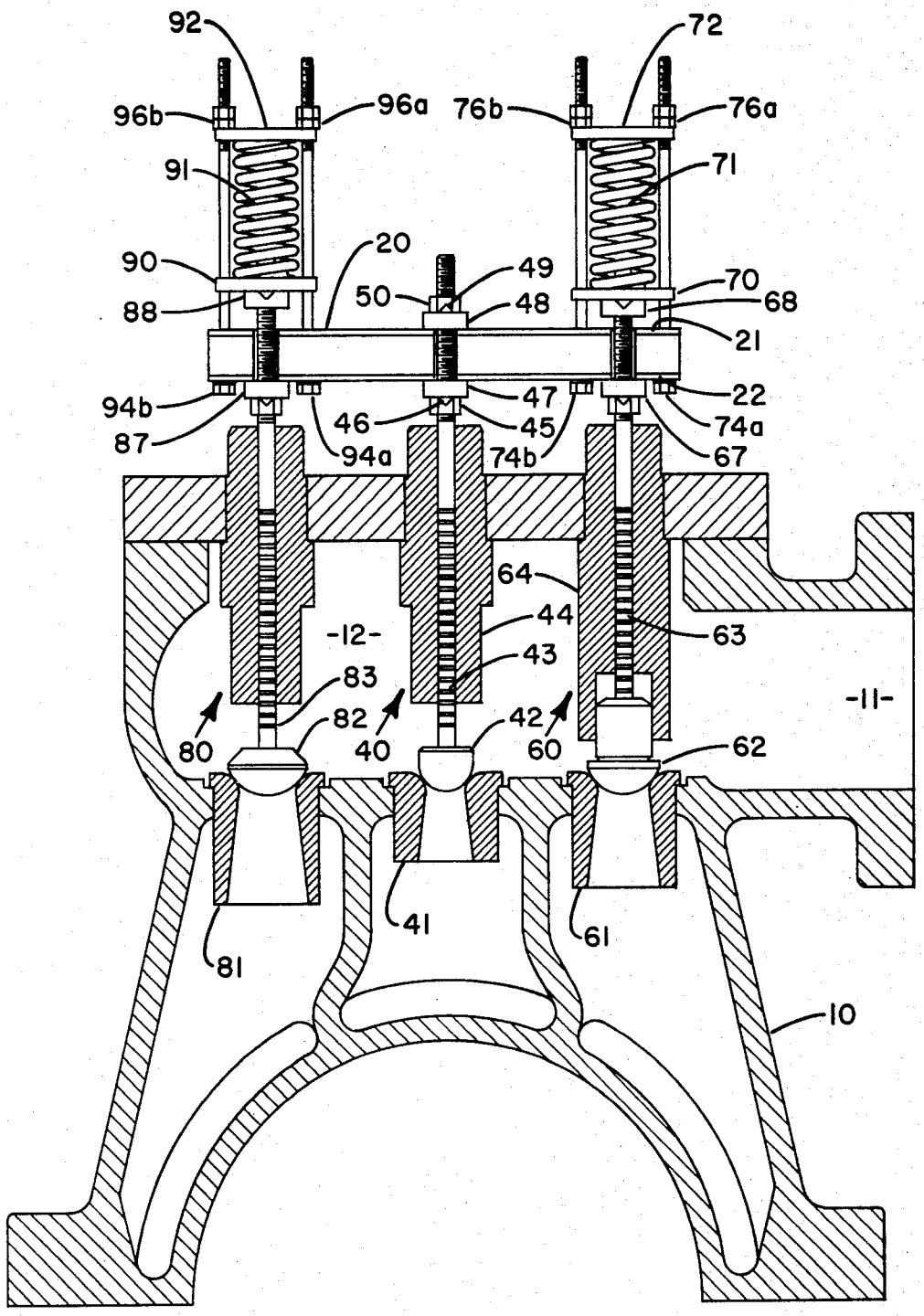
FIG. 2 is a sectional view taken along line II—II of FIG. 1 showing the valves in the closed position.
Figure 3:
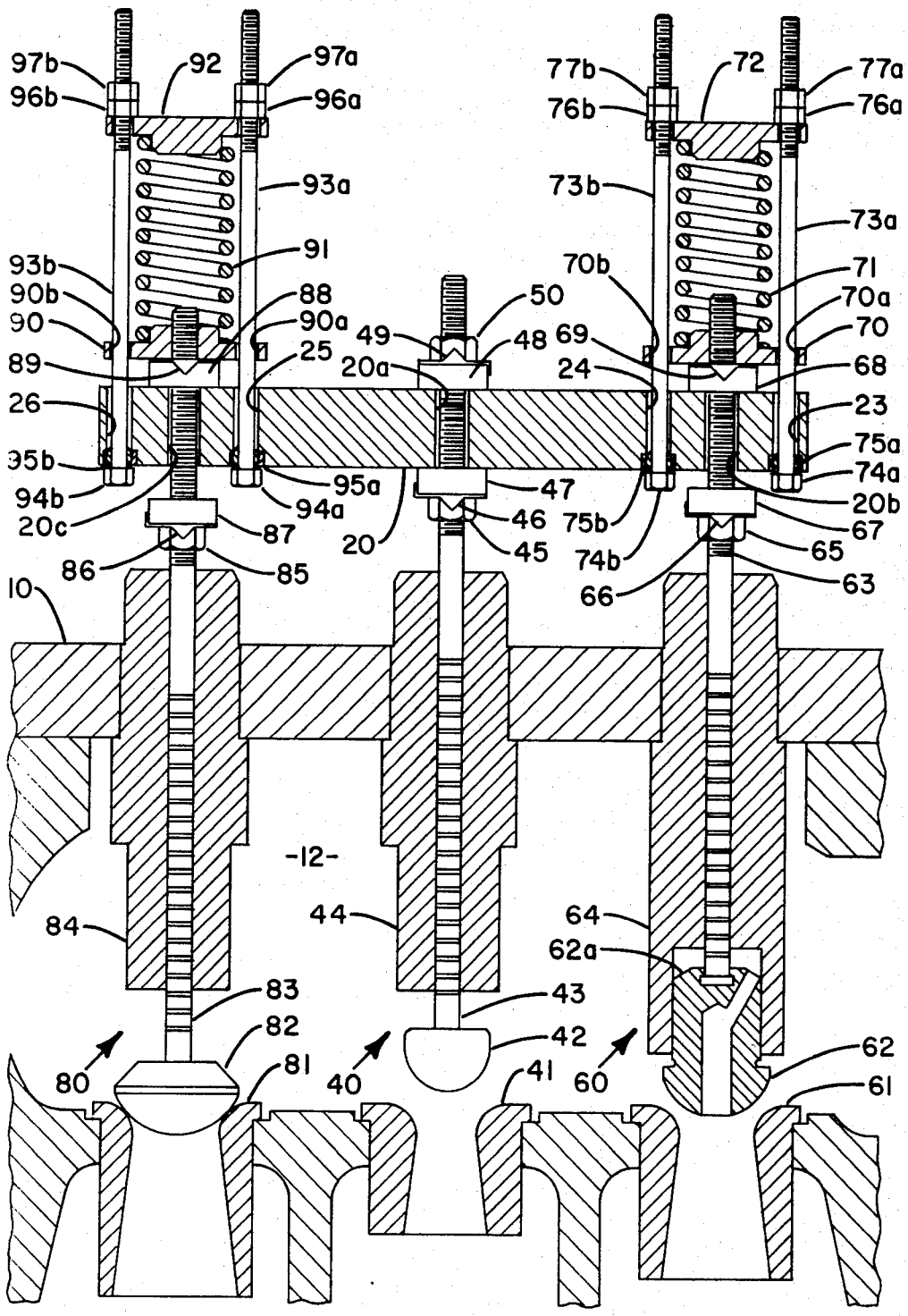
FIG. 3 is a partial, sectioned view generally corresponding to FIG. 2 except that the valves are in a position corresponding to start up of the steam turbine.

In FIGS. 1–3 the numeral 10 generally designates the housing of an axial flow steam turbine having an inlet 11 leading to a steam or valve chest 12. Valves 40, 60 and 80 are located in steam chest 12 and control the flow of steam from steam chest 12 to the turbine blades (not illustrated). A governor-servomotor which includes governor 14 and servomotor 15 is attached to the turbine housing 10 and is driven by the rotor shaft (not illustrated) of the turbine by means of a worm and gear wheel drive. A suitable governor-servomotor is a Woodward PGD-200 manufactured by the Woodward Governor Company of Ft. Collins, Colo., Governor 14 is connected to valves 40, 60 and 80 through a linkage consisting of arm 16 of servomotor 15, link 18 and valve lifting or control bar 20. Valve lifting bar 20 pivots about journal bearings 28 (only one being illustrated) and engages valves 40, 60 and 80 for movement thereof.

Figure 1A:
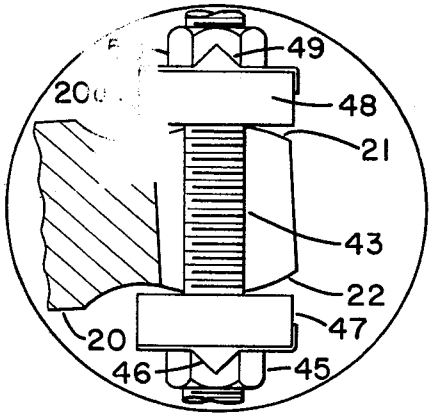
FIG. 1A a detailed view of a portion of the FIG. 1 device.

Valve 40 includes valve seat 41 which is located in the bottom wall of steam chest 12, valve plug 42 and threaded valve stem 43. The valve stem 43 extends through valve guide 44 which is integral with the top wall of steam chest 12 defined by housing 10. Nuts 47 and 48 are threaded on stem 43 and bear against opposite sides of bar 20. Nut 45 and lock washer 46 coact with nut 47 to hold it in place. Similarly, nut 50 and lock washer 49 coact with nut 48 to hold it in place. Lock washers 46 and 49 are in the form of thin metal members of rectangular shape with their corners peened over to prevent the associated nuts from working loose. As best shown in FIG. 1A, the bar 20 is provided with a slot 20*a* for receiving valve stem 43 and curved or rounded surfaces 21 and 22 so as to provide a rolling contact between bar 20 and nuts 47 and 48. This rolling contact is important for free movement of the members since valve stem 43 moves up and down in a straight line while bar 20 pivots about journal bearings 28 and therefore moves in an arc. Because nuts 47 and 48 always are in contact with surfaces 22 and 21, respectively, of bar 20, the valve 40 always moves with bar 20.

Figure 4:
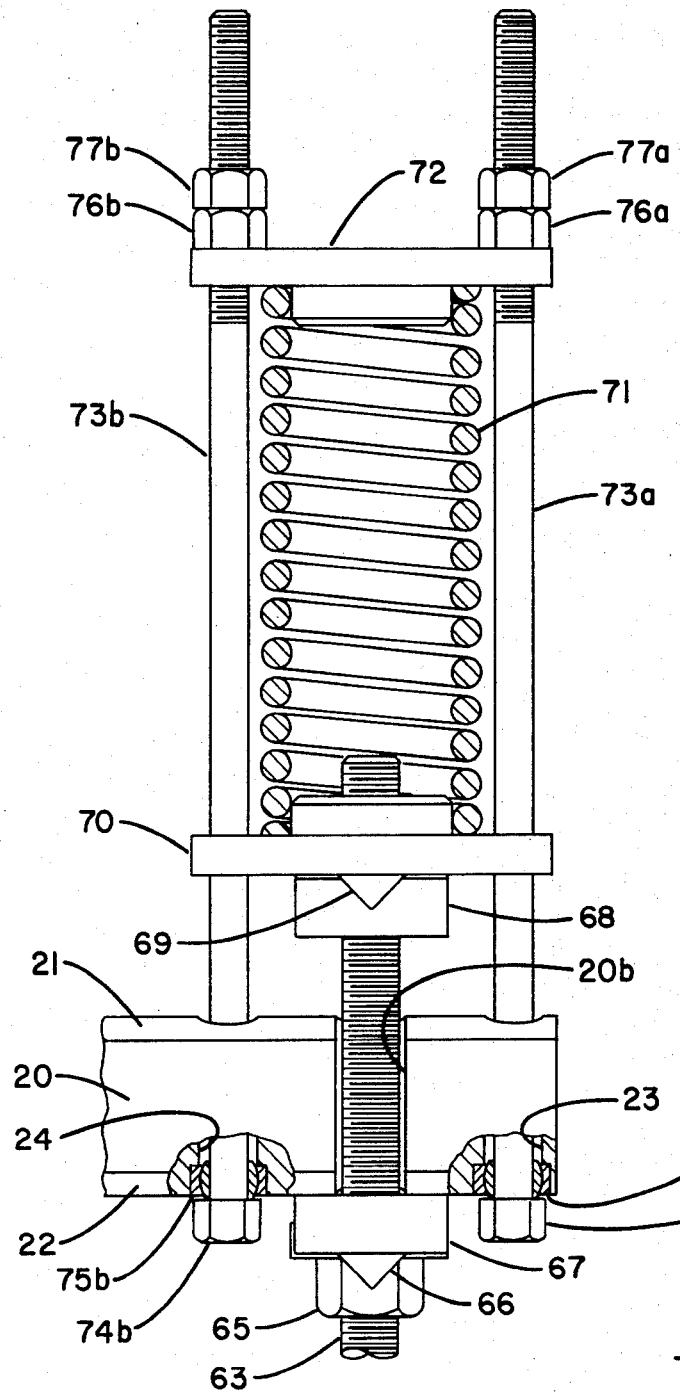
FIG. 4 is a partially sectioned detailed view of the spring structure of the present invention.

Valve 60, as best shown in FIG. 3, is of the balanced piston type to reduce the valve opening force when seated and includes valve seat 61, valve plug 62 and threaded valve stem 63. The piston portion 62*a* of the valve plug 62 will be sized with respect to seat 61 by design considerations. The valve stem 63 slidingly extends through valve guide 64 which is integral with housing 10. As best shown in FIG. 4, nuts 65 and 67 are threaded onto stem 63 with lock washer 66 therebetween. Nut 68 and spring seat 70 are threaded onto stem 63 with lock washer 69 therebetween. The portion of valve stem 63 located between nuts 67 and 68 is received in slot 20*b* of bar 20. Nuts 67 and 68 are spaced apart a greater distance than the curved surfaces 21 and 22 of bar 20 and the difference is the valve lift for valve 60. Spring seat 70 is spaced from spring seat 72 by compression spring 71. Threaded guide rods 73*a* and *b* extend through counterbored passages 23 and 24, respectively, in bar 20 which receive bearings 75*a* and *b*. Serially positioned on guide rod 73*a* are nut 74*a*, bearing 75*a*, spring seat 70, spring seat 72, nut 76*a* and nut 77*a*. Similarly, serially positioned on guide rod 73*b* are nut 74*b*, bearing 75*b*, spring seat 70, spring seat 72, nut 76*b* and nut 77*b*. Compression spring 71 forces spring seat 72 against nuts 76*a* and *b* and nuts 74*a* and *b* against bearings 75*a* and *b*. Spring seat 70 has oversized holes 70*a* and *b* so that it can freely move on guide rods 73*a* and *b* a distance equal to the valve lift for valve 60. Bearings 75*a* and *b* permit guide rods 73*a* and *b* to pivot in passages 23 and 24 such that valve stem 63 and guide rods 73*a* and *b* are always in essentially the same plane for free movement of valve stem 63 and spring seat 70 as bar 20 pivots. In practice, the bar generally swings through an arc of less than $\pm 3\frac{1}{2}°$ from the horizontal which is easily accommodated by oversized holes 70*a* and *b* together with the pivoting of rods 73*a* and *b* and slot 20*b*. Thus, stem 63 and rods 73*a* and *b* can be considered to be in the same plane for practical considerations.

Except for a larger valve lift for valve 80 than for valve 60 and the balanced piston construction for valve 60, valves 60 and 80 are essentially identical in structure and function and all of the structure of valve 80 has been labeled "20" higher than the corresponding structure of valve 60. Valve 80 includes valve seat 81, valve plug 82, threaded valve stem 83 and valve guide 84 which is integral with housing 10. Lock washer 86 is located between nuts 85 and 87 and lock washer 89 is located between nut 88 and spring seat 90. The portion of valve stem 83 located between nuts 87 and 88 is received in slot 20*c* of bar 20. Nuts 87 and 88 are spaced apart a greater distance than the curved surfaces 21 and 22 of bar 20 and the difference is the valve lift for valve 80. The valve lift for valve 80 is greater than that for valve 60. Spring seat 90 is spaced from spring seat 92 by compression spring 91. Threaded guide rods 93*a* and *b* extend through counterbored passages 25 and 26, respectively, in bar 20 which receive bearings 95*a* and *b*. Serially positioned on guide rod 93*a* are nut 94*a*, bearing 95*a*, spring seat 90, spring seat 92, nut 96*a*, and nut 97*a*. Similarly, serially positioned on guide rod 93*b* are nut 94*b*, bearing 95*b*, spring seat 90, spring seat 92, nut 96*b* and nut 97*b*. Compression spring 91 forces spring seat 92 against nuts 96*a* and *b* and nuts 94*a* and *b* against bearings 95*a* and *b*. Spring seat 90 has oversized holes 90*a* and *b* so that it can freely move on guide rods 93*a* and *b* a distance equal to the valve lift for valve 80. Bearings 95*a* and *b* permit guide rods 93*a* and *b* to pivot in passages 25 and 26 such that valve stem 83 and guide rods 93*a* and *b* are always in essentially the same plane for free movement of valve stem 83 and spring seat 90 as bar 20 pivots. Valve stems 43, 63 and 83 and guide rods 73*a* and *b* and 93*a* and *b* are always in essentially the same plane.

Operation

When the axial flow steam turbine is operating, the throttle valve (not illustrated) is open and steam is supplied to steam or valve chest 12 via inlet 11. The steam passes from the steam chest 12 through valve 40 and, additionally, valves 60 and 80, if required by the load. The steam passing through the valve(s) is supplied to the turbine blades (not illustrated) causing the rotor shaft (not illustrated) of the turbine to rotate. The governor 14 is operatively connected to the rotor shaft and, in response to the shaft speed, acts through servomotor 15, arm 16, link 18 and bar 20 to control the position of valves 40, 60 and 80. The valves 40, 60 and 80 open sequentially and close in the reverse sequence with valve 40 opening first and closing last and valve 80 opening last and closing first. When the governor 14 is operative, there is enough force to overcome the biasing forces of springs 71 and 91, if necessary, to position valves 40, 60 and 80 as required.

FIG. 2 represents an extreme condition in that valves 40, 60 and 80 are closed. Since no steam is being supplied to the turbine 10, the only way this condition can exist is if the governor 14 is powered through the inertia of the turbine 10 as from a shut down due to turbine load removal producing a runaway turbine resulting in the closing of valves 40, 60 and 80. That the governor 14 must be powered to produce the FIG. 2 condition results from the fact that compression spring 71 is biasing spring seats 70 and 72 apart and spring seat 70, through nut 68, would move into contact with surface 21 of bar 20 but for the fact that governor 14 is powered. Additionally, spring 91 is biasing spring seats 90 and 92 apart and spring seat 90, through nut 88, would move into contact with surface 21 of bar 20 but for the fact that governor 14 is powered. The governor force must be sufficient to compress the spring 71 the amount necessary for bar 20 to move from contacting nut 68 to contacting nut 67 and to compress the spring 91 the amount necessary for bar 20 to move from contacting nut 88 to contacting nut 87.

In a conventional steam valve structure, the equivalent of the FIG. 2 position would be stable since the valves would be solely weight biased. As a result, an external force would be necessary to open the valves to permit start up of the turbine. In the present invention, the removal of the governor supplied force to bar 20 results in the FIG. 3 position as the inoperative or start up position of the valves. Starting at the FIG. 2 position or at some position intermediate the FIG. 2 and 3 positions, valves 40 and 60 will be opened, or opened further, until the FIG. 3 position is reached. Assuming the FIG. 2 position as the starting point, upon the removal of the governor supplied force, valve 40, in isolation, will act as a weight biased, normally closed valve. Initially ignoring valve 80, spring 71 exerts a force against spring seats 70 and 72. Since spring seat 70 is threaded onto valve stem 63 and is therefore integral with valve plug 62 which is seated on seat 61, spring seat 70 is essentially fixed in the FIG. 2 position, as to movement, by the bias of spring 71. Spring seat 72 is biased against nuts 76*a* and *b* on rods 73*a* and *b*, respectively. Movement of spring seat 72 away from seat 70 is opposed by bar 20 through nuts 74*a* and *b* which are secured to rods 73*a* and *b*, respectively, and engage the bearings 75*a* and *b*, respectively. Since nut 68, which is integral with spring seat 70, and surface 21 of bar 20 are separated, relative movement between bar 20 and nut 68 is possible. The force opposing such movement in the absence of a governor force is the effective weight of pivoted bar 20, the weight of the movable parts of valve 40, friction forces, etc. which in total are much less than the bias of spring 71. As a result, the spring 71 separates spring seats 70 and 72, until nut 68 engages surface 21 of bar 20, by moving bar 20 upward.

When bar 20 is moved upward, starting from the FIG. 2 position, valve 40 opens since there is no relative vertical movement between bar 20 and nuts 47 and 48. Because bar 20 is pivoting, nuts 47 and 48 have a rolling contact with surfaces 22 and 21, respectively, so that valve stem 43 can move freely in a vertical direction and in slot 20*a* in bar 20. Bar 20 goes from contacting nut 67 to contacting nut 68 during which time valve stem 63 moves relative to pivoting bar 20 in slot 20*b* of bar 20 and guide rods 73*a* and *b* pivot in bearings 75*a* and *b*, respectively, so that valve stem 63 and guide rods 73*a* and *b* remain in essentially the same vertical plane even though bar 20 is pivoting. When spring 71 has pushed nut 68 and bar 20 into contact, valve 60 ceases to be spring biased closed and valve 60 effectively becomes a weight biased valve.

Although valve 80 has been ignored up to this point, springs 71 and 91 act in conjunction until spring 71 causes nut 68 and bar 20 to engage and then spring 91 continues to act to achieve the FIG. 3 position. Spring 91 exerts a force against spring seats 90 and 92. Since spring seat 90 is threaded onto valve stem 83, it is integral with valve plug 82 which is seated on seat 81, and spring seat 90 is essentially fixed as to movement by the bias of spring 91 when in the FIG. 2 position. Spring seat 92 is biased against nuts 96*a* and *b* on rods 93*a* and *b*, respectively. Movement of spring seat 92 away from seat 90 is opposed by bar 20 through nuts 94*a* and *b* which are secured to rods 93*a* and *b*, respectively, and engage the bearings 95*a* and *b*, respectively. Since nut 88, which is integral with spring seat 90, and surface 21 of bar 20 are separated, relative movement between bar 20 and nut 88 is possible. There is greater relative movement possible between bar 20 and nut 88 than between bar 20 and nut 68. The force initially opposing such movement in the absence of a governor force is the effective weight of bar 20, the weight of the movable parts of valve 40, friction forces, etc. It will be noted that springs 71 and 91 are both initially providing an opening bias relative to valve 40. As a result, springs 71 and 91 act in concert to move bar 20 until nut 68 engages surface 21 of bar 20 at which point valve 40 will be open and valve 60 will effectively be weight biased. Since further relative movement is possible between bar 20 and nut 88 after nut 68 engages bar 20, the additional movement opens valve 60 and further opens valve 40 both of which then act as weight biased valves relative to spring 91. During this additional movement, nuts 47 and 48 will continue to have rolling contact with surfaces 22 and 21, respectively, and stem 43 will move in slot 20*a*. When nut 68 engages surface 21, further upward movement of the bar 20 will result in rolling contact between nut 68 and surface 21. During all movement of bar 20, valve stem 63 will move in slot 20*b* and rods 73*a* and *b* will pivot about bearings 75*a* and *b* in passages 23 and 24, respectively, so that stem 63 and rods 73*a* and *b* always are in essentially the same vertical plane. Similarly, during all movement of bar 20, valve stem 83 will move in slot 20*c* to accommodate the arcuate movement of bar 20 relative to the valve stem 83 and rods 93*a* and *b* will pivot about bearings 95*a* and *b* in passages 25 and 26, respectively, so that stem 83 and rods 93*a* and *b* always are in essentially the same vertical plane as valve stems 43 and 63 and rods 73*a* and *b*.

When the FIG. 3 position has been reached either due to the absence of a governor force or as the required position due to the governor force, any further opening movement will be without assistance or opposition from springs 71 and 91. This is because once nuts 68 and 88 engage the bar 20 no further expansion movement of springs 71 and 91 is possible and the springs are effectively disabled for further opening movement of the valves 40, 60 and 80 and governor 14 needs to only act against the effective weight of bar 20 and the movable valve members to further open the valves 40 and 60 and to open valve 80. However, closing of the valves starting with the FIG. 3 position would require the governor 14 to compress spring 91 until valve 60 was seated and then to further compress spring 91 and to compress spring 71 until valve 40 was seated and the FIG. 2 position was reached. Because valve 40 has no relative vertical movement with respect to bar 20 and because valves 40 and 60 are so heavily biased by springs 71 and 91, respectively, valves 40, 60 and 80 are not subject to vibration due to the passage of steam through the steam chest 12. This results in a longer valve life and overcomes a problem associated with weight biased valves having a valve lift.

Although a preferred embodiment of the present invention has been illustrated and described, other changes will occur to those skilled in the art. For example, valve 40 can be spring biased with no lift so as to insure against vibration of the valve due to wear of the members which permit movement. Also, the number of valves can be varied with two valves being the minimum and design considerations dictating the maximum number of valves. It is therefore intended that the scope of the present invention is to be limited only by the scope of the appended claims.

What is claimed is:

1. A fluid admission valve structure for a turbine comprising:

a valve chest having a top wall and a bottom wall;

a linear series of vertically disposed passages in said bottom wall;

a valve seat in each of said passages;

a valve cooperable with each of said valve seats;

each of said valves having an integral stem extending outwardly through said top wall in a sliding relationship;

means mounted externally of said valve chest including a governor for positioning said valves in response to turbine load and means for opening at least one of said valves when said governor is at rest; and said means mounted externally of said valve chest coacting with each of said valve stems to vertically reciprocate and thereby open and close said valves in a sequential manner.

2. The fluid admissiion valve structure of claim 1 wherein each of said valve stems is in the same vertical plane.

3. A fluid admission valve structure for a turbine comprising:

a valve chest having a top wall and a bottom wall;

a linear series of vertically disposed passages in said bottom wall;

a valve seat in each of said passages;

a valve cooperable with each of said valve seats;

each of said valves having an integral stem extending outwardly through said top wall in a slidable relationship;

a first stop means located on each of said stems at a first position;

a second stop means located on each of said stems at different distances from said first stop means;

means mounted externally of said valve chest including a pivoted bar for coacting with said first and second stop means and a governor for positioning said pivoted bar and thereby said valves in response to turbine load; and said means mounted externally of said valve chest coacting with said first and second stop means to vertically reciprocate and thereby open and close said valves in a sequential manner.

4. The fluid admission valve structure of claim 3 wherein each of said valves except one is provided with a spring biasing means which tends to cause said second stop means of said spring biased valves to engage said bar and said second stop means of said one valve always engages said bar.

5. A sequentially operable admission valve structure for a turbine comprising:

a valve chest having a top wall and a bottom wall;

a linear series of vertically disposed passages in said bottom wall;

a valve seat in each of said passages;

a valve cooperable with each of said valve seats;

each of said valves having an integral stem extending outwardly through said top wall in a slidable relation- ship;

lifting bar means mounted externally of said valve chest for pivoted movement and having a plurality of openings for freely receiving each of said valve stems;

a first stop means located on each of said stems at a first position and engagable by said bar means to cause each of said valves to close;

a second stop means located on each of said stems at different distances from said first stop means and engagable by said bar means to cause each of said valves to open;

a first one of said valve stems having said first and second stop means located thereon in continuous engagement with said bar means in all positions of said bar means; and each of the remainder of said valve stems having no more than one of said first and second stop means thereon in engagement with said bar means.

6. The sequentially operable admission valve structure of claim 5 further including governor means for positioning said bar means and thereby said valves in response to turbine load.

7. The sequentially operable admission valve structure of claim 5 further including spring biasing means for biasing the valves of each of the remainder of said valve stems onto their corresponding valve seat when seated and said second stop means into engagement with said bar means when unseated.

* * * * *